US005119620A

United States Patent [19]

Braxmeier

[11] Patent Number: 5,119,620

[45] Date of Patent: Jun. 9, 1992

[54] HOLDING ARRANGEMENT FOR A SPINDLE OF RING SPINNING OR RING TWISTING MACHINES

[75] Inventor: Hans Braxmeier, Süssen, Fed. Rep. of Germany

[73] Assignee: Wilhelm Stahlecker GmbH, Fed. Rep. of Germany

[21] Appl. No.: 682,313

[22] Filed: Apr. 9, 1991

[30] Foreign Application Priority Data

May 17, 1990 [DE] Fed. Rep. of Germany ..... 4015813

[51] Int. Cl.[5] ..... D01H 7/08; D01H 7/14; F16C 23/00

[52] U.S. Cl. ..... 57/132; 57/135; 384/229; 384/258

[58] Field of Search ..... 57/104, 129–135; 384/229, 247, 252, 258

[56] References Cited

U.S. PATENT DOCUMENTS

| | | | |
|---|---|---|---|
| 677,994 | 7/1901 | Kelly | 384/229 |
| 729,221 | 5/1903 | Rhoades | 384/229 |
| 2,207,896 | 7/1940 | Rothschild | 57/135 |
| 2,405,889 | 8/1946 | Kennedy | 384/229 X |
| 2,609,254 | 9/1952 | Harris | 57/135 |
| 2,954,661 | 10/1960 | Rowe, Jr. | 57/132 |
| 3,835,634 | 9/1974 | Anderson et al. | 57/130 |
| 4,725,152 | 2/1988 | Heinrich et al. | 384/229 X |

FOREIGN PATENT DOCUMENTS

| | | |
|---|---|---|
| 3320056 | 9/1984 | Fed. Rep. of Germany . |
| 236122 | 5/1986 | Fed. Rep. of Germany . |

*Primary Examiner*—Daniel P. Stodola
*Assistant Examiner*—Michael R. Manson
*Attorney, Agent, or Firm*—Evenson, Wands, Edwards, Lenahan & McKeown

[57] ABSTRACT

A holding arrangement for a spindle of ring spinning or ring twisting machines. The holding arrangement includes a spindle housing which can be inserted in a receiving bore of a spindle rail and tightened by a ring flange and a nut screwed onto an external thread. The receiving bore includes a guide surface for guiding the spindle housing over only a portion of the length of the receiving bore while permitting tilting of the spindle housing in the receiving bore. Between the spindle rail and the ring flange and/or the nut, an adjusting ring is arranged which can be rotated when the nut is at least loosened. The adjusting ring is constructed as a non-uniform spacing element, by the rotating of which the relative position of the spindle housing and the spindle rail can be adjusted.

19 Claims, 3 Drawing Sheets

HOLDING ARRANGEMENT FOR A SPINDLE OF RING SPINNING OR RING TWISTING MACHINES

BACKGROUND AND SUMMARY OF THE INVENTION

The invention relates to a holding arrangement for a spindle of ring spinning or ring twisting machines which, by means of a spindle housing, can be inserted into a receiving bore of a spindle rail and can be fastened by means of tightening elements.

In the case of spindles of ring spinning or ring twisting machines, it is known to provide possibilities by means of which the spindles can be centered with respect to rings. This is frequently necessary in order to compensate inaccuracies of manufacture. It is known from German Patent Document DD-A 236 122 to introduce inserts into the receiving bore of the spindle rail which are provided with spherical bearing surfaces to which conical surfaces of a ring flange and of a nut of the spindle housing are assigned. The position, which is adjusted by the manual swivelling of the spindle housing, is subsequently fixed by the tightening of the nut. The adjusted position is based on a pure frictional connection.

It is also known from German Patent Document DE-C 33 20 056 to mount a fastening sleeve on the spindle housing which is provided with a ring flange and an external thread for a nut. The fastening sleeve is provided with a relatively short fastening collar which is pressed onto the bearing housing. For the adjusting, the spindle housing is swivelled into the corresponding position, a deformation taking place in the area of the fastening collar. At an axial distance to the fastening collar, the spindle housing is equipped with a fixing collar which, for fixing the adjusted position, is clamped in between the end of the fastening sleeve and a swivel nut screwed onto the external thread of the fastening sleeve. The fixing of the adjusted position is based on a pure frictional connection.

In the case of the known holding arrangements, the adjusting, which takes place by a manual swivelling, cannot be carried out in a particularly sensitive manner, particularly if a radial force becomes effective during the adjusting against which the adjusting may be required, particularly the force of a tangential belt acting upon a wharve of the spindle.

It is an object of the invention to provide a holding arrangement of the initially mentioned type which permits a sensitive positioning of the spindle, particularly also against a force causing a deflecting from the adjusted position.

This object is achieved in that an adjusting ring is arranged between the spindle rail and a ring flange of the spindle housing and/or a nut screwed onto the spindle housing which can be rotated at least when the tightening elements are loosened and which is designed as a non-uniform distance spacing element by the rotation of which the relative position of the spindle housing and the spindle rail can be adjusted.

As a result of this construction, it is possible to carry out a very sensitive positioning of the spindle by rotating the adjusting ring. It is particularly advantageous in this case that the adjusting ring causes the adjusting because of its shaping and then also maintains the adjusted position. The adjusted position is then secured in a form-locking manner. As a result, a precise centering of the spindle can also be carried out when a deflecting force acts upon the spindle during the centering, particularly the force of a belt driving the spindle. The maintaining of the adjusted position is therefore also not dependent on the force which is applied by the tightening of the nut.

Other objects, advantages and novel features of the present invention will become apparent from the following detailed description of the invention when considered in conjunction with the accompanying drawings.

DETAILED DESCRIPTION OF THE DRAWINGS

Figure 1:
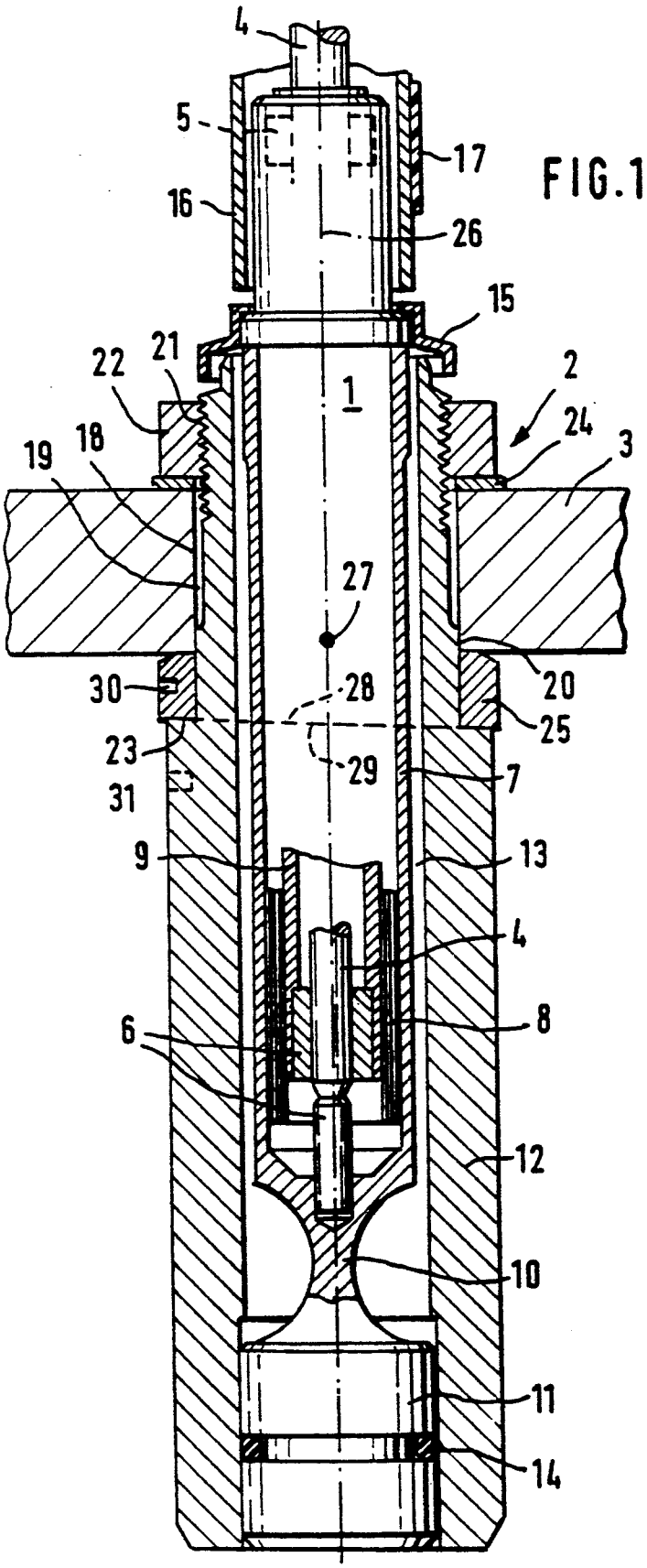
FIG. 1 is a partial axial sectional schematic view of a spindle with a holding arrangement of a first embodiment of the invention.

In the case of the embodiment according to FIG. 1, the spindle 1 is fastened to a flange of a spindle rail by means of a holding arrangement 2. The spindle 1 comprises an only partially shown spindle top part which with a shaft 4 is disposed in a spindle bearing housing 7 by means of a bolster 5 and a step bearing 6. The step bearing 6 has a bearing sleeve, which absorbs radial forces and is held in a centering tube 9 which is surrounded by a damping spiral 8.

Connecting to the step bearing 6, the spindle bearing housing 7 is provided with a pin-type projection 10, which is used as a narrow point and changes into a cylindrical projection 11, the outer diameter of which is larger than the outer diameter of the spindle bearing housing 7. The cylindrical projection 11, which receives a sealing ring 14 in a ring groove, is pressed into the lower end of a spindle housing 12 which surrounds the spindle bearing housing 7 while leaving a ring gap 13 and reaches into the area up to the proximity of the bolster 5.

In comparison to the spindle bearing housing 7, the spindle housing 12 is constructed to be thick-walled. Its upper end is covered, in a no-contact manner, by a ring-shaped covering 15 which is held on the spindle bearing housing 7. With the area of its bolster 5, the spindle bearing housing 7 projects upward out of the spindle housing 12. In this area, a driving wharve 16 of the spindle top part is situated which, in a manner not shown in detail, is non-rotatably connected with the shaft 4. At this driving wharve 16, the drive of the spindle top part takes place, for example, by means of a tangential belt 17.

The fastening of the spindle 1 takes place on the flange of the spindle rail 3 by means of the holding arrangement 2 mounted on the spindle housing 12. The flange is provided with a receiving bore 18 into which the spindle housing 12 can be inserted from below. The receiving bore 18 surrounds the spindle housing 12 in the area of the holding arrangement 2 while leaving an annular gap 19. Only in the area facing a ring collar 23 of the spindle housing 12, the spindle housing 12 is guided in the receiving bore 18 by means of section 20 which has a relatively small axial dimension by means of which it projects into the receiving bore 18. The axial dimension is in the order of 2 to 3 mm. With respect to the receiving bore 18, the section 10 has little play which is dimensioned such that slight tilting movements of the spindle housing 12 are possible with respect to the flange of the spindle rail 3, as will be described in detail in the following.

The upper end of the spindle housing 12 is provided with an external thread 21 onto which a nut 22 is screwed which, with the insertion of a spring ring 24, supports itself against the upper side of the flange of the spindle rail 3. Between the flange and the ring flange 23, an adjusting ring 25 is arranged which is guided on an extension of the section 20 of the spindle housing 12.

For a perfect functioning, it is required that the axis 26 of the spindle shaft 4 is centered, particularly with respect to a spinning ring not shown in the drawing which is arranged above the spindle rail on a ring rail. This centering first serves the compensating of manufacturing tolerances. However, in the case of a spindle 1 of the type illustrated in FIG. 1, there is also the danger that the force applied by the driving belt 17 and acting radially with respect to the wharve 16 and to the shaft 4 leads to an elastic deformation, particularly in the area of the pin-shaped projection 10, which must be compensated. This adjusting takes place by means of the above-mentioned adjusting ring 25, in which case the position of the spindle housing 12 is adjusted with respect to the flange of the spindle rail 3, and thus also the position of the axis 26 of the shaft 4. The adjusting ring 25 has a first contact surface by means of which it rests on the flange of the spindle rail 3 in the axial direction. This contact surface extends exactly radially with respect to the longitudinal axis of the spindle housing 12 and therefore also (in the unloaded condition) exactly radially with respect to the axis 26 of the spindle shaft 4. The opposite second contact surface 28, by means of which the adjusting ring 25 rests against the contact surface 29 of the ring flange 23, has a slight deviation with respect to the radial line which is in the order of less than 1°. This contact surface 28 therefore has a slight wobble. Contact surface 29 has the same wobble so that, in a zero position, there is a precise centering between the spindle housing 12 and the spindle shaft 4.

Figure 2:
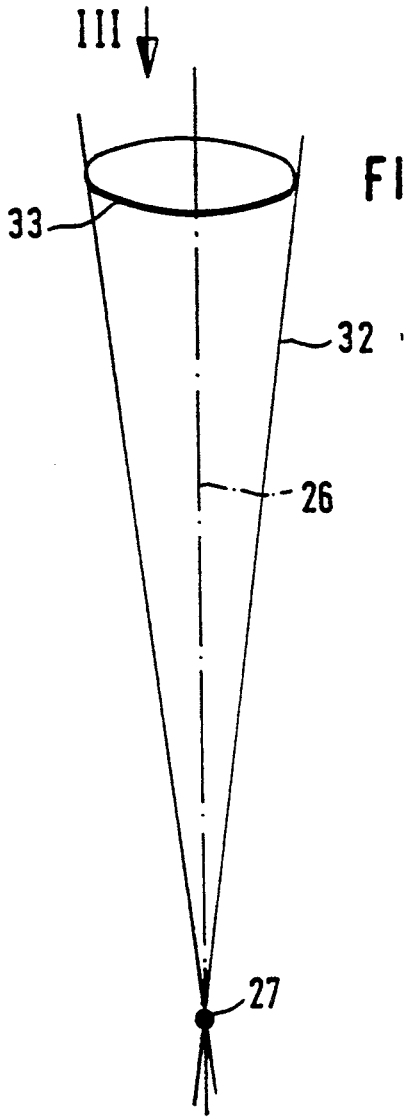
FIG. 2 is a schematic representation of the adjusting range of the embodiment according to FIG. 1.
Figure 3:
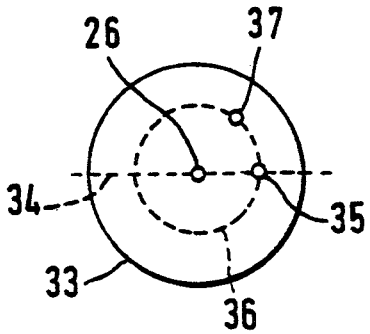
FIG. 3 is a view of FIG. 2 in the direction of the Arrow III.

During the mounting of the spindle 1, the spindle 1, by means of the holding arrangement 2, is brought into the position illustrated in FIG. 1, in which case the nut 22 is tightened only slightly. By mean of the subsequent rotating of the adjusting ring 25, the relative slope of the spindle housing 12 with respect to the flange can then be changed and thus also indirectly the position of the axis 26 of the spindle shaft 4. The spindle housing 12 can thus be swivelled about a point 27 which is situated at the level of the section 20 of the spindle housing 12, by means of which this spindle housing is guided in the receiving bore 18. This adjusting cone is illustrated in FIGS. 2 and 3. Starting from the dash-dotted center line, which in FIG. 2 represents the ideal position of the spindle axis 26 of the spindle shaft 4, virtually any position can be achieved within the adjusting cone 32 illustrated in FIG. 2. If the adjusting ring 25 is rotated starting from the center position (FIG. 3), the axis 26, for example, moves on a radial line 34 into position 35. If now the spindle housing 12 and the adjusting ring 25 are rotated jointly, the axis will then move on the circular path 36, for example, into position 37. As mentioned above, by means of this adjusting, any position can be obtained within the area of the adjusting cone 32. The practical approach is therefore that first, by the rotating of the adjusting ring 2 (or of the spindle housing 12), the extent of the deflection is corrected while subsequently, by means of the joint rotating of the adjusting ring 25 and of the spindle housing 12, the desired position is fixed. Then the nut 22 is tightened so that the spindle 1 is fixed in this position. In this case, it is an advantage that the then occurring forces do not act in the rotating direction of the adjusting ring 25 so that this centering is dependent only on the position of the adjusting ring 25 and of the spindle housing 12 but not on the force by which the nut 22 is tightened.

During this adjusting or centering, the spindle housing 12, in the area of its section 20, must be able to carry out slight tilting motions in the receiving bore 18 without the occurrence of a plastic deformation. For this purpose, it is provided that the length of the section 20 is relatively short while, at the same time, a slight radial play is left which allows this tilting motion.

As also indicated in FIG. 1, the contact surfaces 28, 29 between the adjusting ring 25 and the ring flange 23 of the spindle housing 12 are larger than the contact surface of the adjusting ring 25 with respect to the flange of the spindle rail 3. This is achieved in that the contact surface of the adjusting ring 2 which faces the flange is chamfered.

As also shown in FIG. 1, the spindle housing 12 and the adjusting ring 25 are provided with working surfaces for a tool which are constructed as blind bores 30, 31. The blind bores 30, 31, at the same time, represent a marking by means of which the spindle housing 12 and the adjusting ring 25 can be adjusted to the neutral adjustment, for example, if the blind bores 30, 31 are exactly axially opposite one another.

Figure 4:
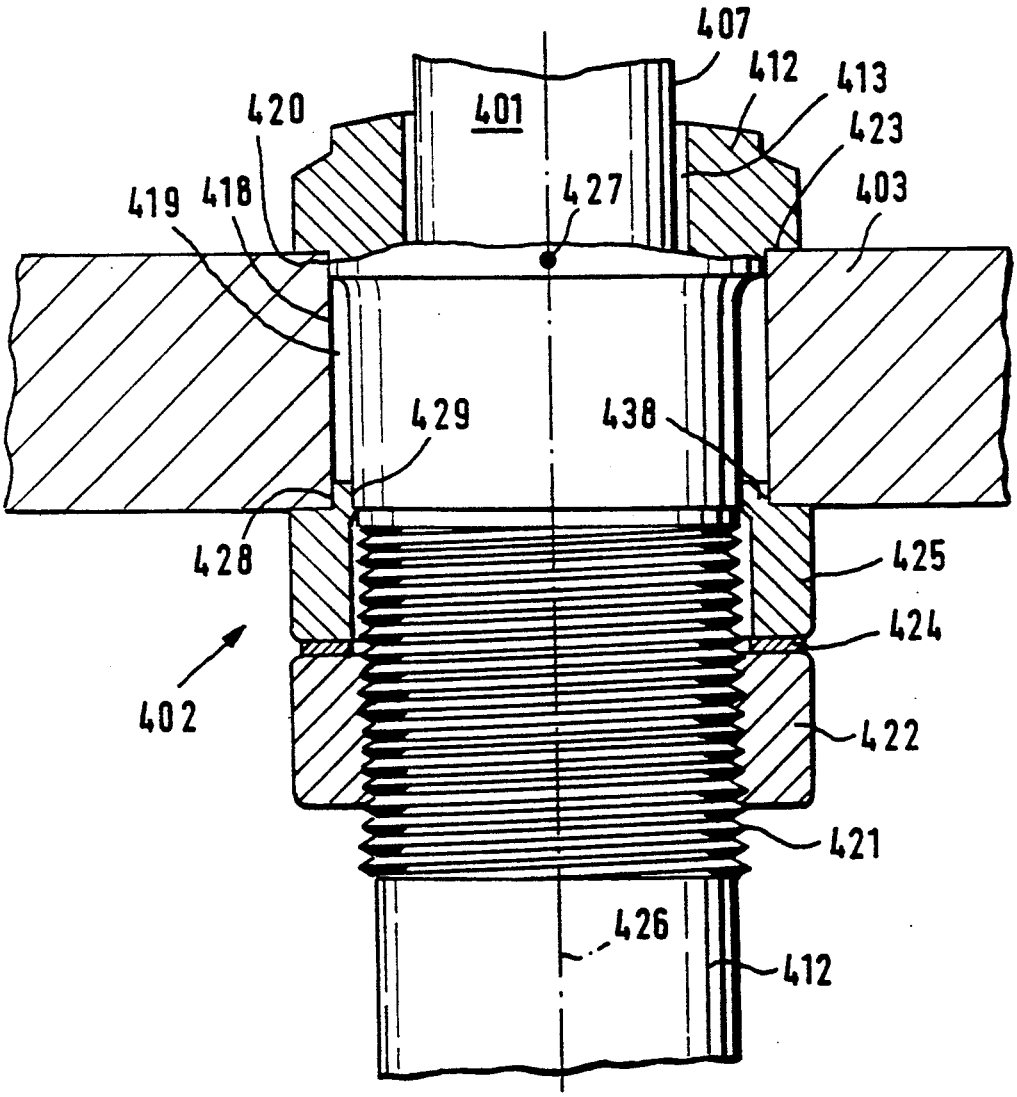
FIG. 4 is a partial axial sectional view of another embodiment.

In the case of the embodiment according to FIG. 4, the constructional elements which, in their function, correspond to the constructional elements of the embodiment according to FIG. 1, have reference numbers whose end digits, in each case, correspond to the corresponding components according to FIG. 1, in which case, these reference numbers are each preceded by a "4". Thus, reference can partly be made to the preceding description so that this description does not have to be repeated with respect to FIG. 4.

In the embodiment according to FIG. 4, the spindle housing 412, at its upper end, is provided with a ring flange 423 which places itself from above on the flange of the spindle rail 403 when the spindle housing 412 is fitted through the receiving bore 418 from above. A ring-collar-type section 420, the diameter of which, with a slight play, corresponds to the inside diameter of the receiving bore 418, is connected to the ring flange 423. The axial dimension of this section 420 is smaller than 2 mm. This section 420 is followed by a section with a reduced diameter so that an annular gap 419 is left with respect to the spindle housing 412. This section, which is smaller in its diameter, is provided with an external thread 421 onto which a nut 422 is screwed. The holding arrangement 402 is completed by means of an adjusting ring 425 which is arranged between the nut 422 and the flange of the spindle rail 403. A spring ring 424 is arranged as a slide ring between the nut 422 and the adjusting ring 425.

The adjusting ring 425, which has a larger inside diameter than the external thread 421, has an annular projection 438 which projects into the gap 419 by means of an extension of a few millimeters, preferably of less than 3 mm. The projection 438 has an inside diameter 429 which corresponds to the outside diameter of the spindle housing 412 in the area of the receiving bore 418. In addition, the projection 438 has an outside diameter 428 which corresponds to the inside diameter of the receiving bore 418. The inside diameter 429 and the outside diameter 428 of the projection 438 are offset with respect to one another by an eccentricity which is in the range from 0.15 mm to 0.3 mm.

In the basic position, the adjusting ring 425 is adjusted such that the spindle axis 426 coincides with the axis of the receiving bore 418. When the adjusting ring 425 is rotated out of this basic position, which takes place by means of a tool which is applied to tool working surfaces, which are not shown, as long as the nut 422 is not yet completely tightened, the spindle housing 412, with the spindle shaft contained in it, is swivelled about a swivel point 427 which is in the area of the section 420. This results in virtually the same adjusting possibilities as those explained by means of FIGS. 2 and 3.

Here also, the extent of the swing can be determined in that the adjusting ring 425 alone is rotated. If then the spindle housing 412 is rotated together with the adjusting ring 425, the direction of the slope can be determined. In order to permit a rotating of the spindle housing 412, the spindle housing 412 is provided with tool working surfaces in the area of the ring flange 423.

The invention also contemplates other preferred embodiments using similar construction principles, specifically by using relatively rotatable parts and rotating same to change the angular position of a spindle housing 12, 412 with respect to the receiving bore 18, 418 of a flange of a spindle rail 3, 403. For example, it is contemplated to provide, instead of a ring 438 with an eccentric inner surface 429 and outer surface 428, an adjusting ring which is provided with correspondingly arranged pins so that closed ring surfaces no longer project into the annular gap 419. It is also contemplated to arrange the adjusting ring 25 between the nut 22 and the spindle rail 3. In this case, it is contemplated to divide the nut 22 in a radial plane so that an additional ring is obtained which does not rotate along when the nut is tightened and which has the sloped contact surface facing the adjusting ring 25. In this type of an embodiment, there will then be two adjusting rings.

Although the invention has been described and illustrated in detail, it is to be clearly understood that the same is by way of illustration and example, and is not to be taken by way of limitation. The spirit and scope of the present invention ar to be limited only by the terms of the appended claims.

What is claimed is:

1. A holding arrangement for holding a spindle of a ring spinning or twisting machine, comprising:

a spindle housing for supportably housing a spindle shaft, a spindle rail having a receiving bore for accommodating insertion of the spindle housing, said receiving bore including a guide surface for guiding the spindle housing over only a portion of the length of the receiving bore while permitting tilting of the spindle housing in the receiving bore, a securing element for securing the spindle housing to the spindle rail, and an adjusting rail for adjusting the relative position of the spindle housing and spindle rail, said adjusting ring having an inner cylindrical surface arranged on an outer cylindrical surface of the spindle housing, said adjusting ring being interposed between the spindle housing and spindle rail at the receiving bore, said adjusting ring being configured as a non-uniform spacing member which changes the adjusted position of the spindle housing and spindle rail in dependence on the relative rotation position of the adjusting ring.

2. A holding arrangement according to claim 1, wherein said securing element includes a threaded clamping ring for selectively clamping the spindle housing to the spindle rail.

3. A holding arrangement according to claim 1, wherein the securing element includes a ring flange on the spindle housing and a threaded nut which is screwed onto an external thread of the spindle housing, which flange and nut receive the spindle rail between one another, and wherein the adjusting ring has a first contact surface which extends radially with respect to a longitudinal axis of the spindle housing and is assigned to the spindle rail, and a second contact surface which is sloped with respect to the radial direction and is opposite a correspondingly sloped contact surface of one of the ring flange and the nut.

4. A holding arrangement according to claim 3, wherein at least one of the spindle housing and the adjusting ring are provided with devices for the application of a tool for adjusting the relative position of the adjusting ring.

5. A holding arrangement according to claim 1, wherein the spindle housing is guided in the receiving bore of the spindle rail by a ring collar-type section.

6. A holding arrangement according to claim 5, wherein the ring collar-type section connects to an area in which the adjusting ring is centered on the spindle housing.

7. A holding arrangement according to claim 6, wherein at least one of the spindle housing and the adjusting ring are provided with devices for the application of a tool for adjusting the relative position of the adjusting ring.

8. A holding arrangement according to claim 1, wherein the adjusting ring is provided with a projection which projects into an annular gap between the receiving bore of the spindle rail and of the spindle housing, and wherein the inner and outer circumferential surfaces of which projection are eccentric with respect to one another.

9. A holding arrangement according to claim 8, wherein the securing element includes a nut screwed onto the spindle housing, and wherein the adjusting ring is arranged between the spindle rail and the nut screwed onto the spindle housing, and wherein a slide ring is arranged between the adjusting ring and the nut.

10. A holding arrangement according to claim 9, wherein at least one of the spindle housing and the adjusting ring are provided with devices for the application of a tool for adjusting the relative position of the adjusting ring.

11. A holding arrangement according to claim 9, wherein the spindle housing is provided at an axial distance with respect to the ring-shaped projection of the adjusting ring with a ring-collar-type section which is guided in the receiving bore of the spindle rail.

12. A holding arrangement according to claim 11, wherein at least one of the spindle housing and the adjusting ring are provided with devices for the application of a tool for adjusting the relative position of the adjusting ring.

13. A holding arrangement according to claim 12, wherein the devices for the application of a tool are constructed as markings.

14. A holding arrangement according to claim 13, wherein the thread for a nut is located below the spindle rail.

15. A holding arrangement according to claim 13, wherein the thread for a nut is located above the spindle rail.

16. A holding arrangement according to claim 8, wherein the spindle housing is provided at an axial distance with respect to the ring-shaped projection of the adjusting ring with a ring-collar-type section which is guided in the receiving bore of the spindle rail.

17. A holding arrangement according to claim 1, wherein at least one of the spindle housing and the adjusting ring are provided with devices for the application of a tool for adjusting the relative position of the adjusting ring.

18. A holding arrangement according to claim 17, wherein the devices for the application of a tool are constructed as markings.

19. A holding arrangement according to claim 1, wherein the securing element includes a ring flange at the spindle housing and an external thread for a nut surrounding the spindle bearing housing at a spacing from the ring flange.

* * * * *